US005708989A

United States Patent [19]

Ellis

[11] Patent Number: 5,708,989

[45] Date of Patent: Jan. 20, 1998

[54] TOILET SEAT ASSEMBLIES

[75] Inventor: William Edwin Gordon Ellis, Allestree, England

[73] Assignee: Gordon Ellis and Company, Derby, England

[21] Appl. No.: 621,873

[22] Filed: Mar. 20, 1996

[30] Foreign Application Priority Data

Mar. 23, 1995 [GB] United Kingdom ..... 9505884

[51] Int. Cl.[6] ..... A47K 13/26

[52] U.S. Cl. ..... 4/237; 4/254

[58] Field of Search ..... 4/234, 235, 236, 4/237, 239, 240, 242.1, 254

[56] References Cited

U.S. PATENT DOCUMENTS

| | | | |
|---|---|---|---|
| 848,043 | 3/1907 | McCord et al. | 4/237 X |
| 1,217,506 | 2/1917 | Riihikoski | 4/239 |
| 2,358,265 | 9/1944 | Thomas | 4/254 |
| 3,171,138 | 3/1965 | Brunelle | 4/237 |
| 3,474,471 | 10/1969 | Matibag | 4/254 |
| 3,971,077 | 7/1976 | O'Neil | 4/239 |
| 4,214,323 | 7/1980 | Thomas | 4/237 |
| 4,462,122 | 7/1984 | Broeils | 4/239 |
| 4,964,179 | 10/1990 | Kimes | 4/239 |

FOREIGN PATENT DOCUMENTS

| | | |
|---|---|---|
| 0153507 | 9/1985 | European Pat. Off. . |
| 0161352 | 11/1985 | European Pat. Off. . |
| 0601795 | 6/1994 | European Pat. Off. . |

*Primary Examiner*—Robert M. Fetsuga
*Attorney, Agent, or Firm*—Adams Law Firm, P.A.

[57] ABSTRACT

A toilet seat assembly includes a toilet seat (40) and a seat holding bar assembly (30,130) for removably holding the seat on a toilet bowl (10,110), the seat having a rearwardly directed extension (72,74,172) including two spaced upwardly directed surfaces (80,190) each of which has one or more recesses (79,179), the seat holding bar assembly (30,130) being rigidly attachable to the toilet bowl (10,110) and having an outwardly directed projection (39,139) at each end which extends beyond the edges of the rear of the toilet bowl so that the seat (40) can be fitted to the bowl with the upwardly directed surfaces below the bar projections (39,139) with the projections located in said recesses (79, 179).

12 Claims, 3 Drawing Sheets

TOILET SEAT ASSEMBLIES

The present invention concerns a toilet seat assembly especially but not exclusively a toilet seat assembly for use by elderly, disabled or infirm people which raises the level of the seating area above that provided by a conventional toilet seat.

There are presently in existence many toilet seats for use as a substitute for an existing conventional toilet seat, which raise the level of the seating area such that a disabled person can readily use the-thus modified toilet bowl and seat assembly. Some of these existing raised seats comprise of a ring-shaped seat having a greater thickness than normal, made, for example, from plastics material by rotational moulding and having on their under-sides a downwardly depending flange adapted to be accommodated within the upper regions of a toilet bowl. Whereas such raised toilet seats have the convenience of economy, they are often disadvantageous in that, in view of the non-standard shape of toilet bowls, they do not securely fit the toilet bowl and, consequently, they can be unstable in use. A toilet seat of this general type is described in European Patent Application No. 0153507A1.

Attempts have been made, with varying degrees of success, to provide raised toilet seats of this type with clamping means by which they can be clamped to the toilet bowl. One such proposal has been to provide a multi-point clamping means comprising two opposed clamping means which may or may be adjustable to the front of the raised seat and two opposed adjustable clamping means towards the rear of the seat. The clamping means on loosening clamping bolts, to be adjusted such that there is a four point clamping action between the clamping means and the external surface of the toilet bowl, the adjustable clamp means being maintained in their adjusted position by screwing down fixing bolts. These arrangements are disadvantageous in that, for example, they are relatively difficult to fit and to remove to reconvert the toilet for use in a normal mode. An example of such a toilet seat is shown in European Patent Application No. 0161352A1.

There have been proposals in the past to fit raised toilet seats with arms, which obviously aid disabled persons when they are sitting on and getting up from the toilet seat. Such arrangements have not been particularly satisfactory as it has been found difficult to economically provide arms which have sufficient rigidity, not only inherent rigidity but also firm connection to the normally hollow plastics material toilet seat. Of more concern, however, is that the fitment of arms increases by at least a factor of two the width of the seat and arm assembly and it will be obvious that if a greater load is placed on one of the arms, for example, when someone is sitting down or getting up from the seat, the side-to-side tilting movement on the raised toilet seat is considerably magnified and this, coupled to the poor clamping efficiency, gives rise to very dangerous instability. A proposal to provide arms for a toilet seat is made in U.S. Pat. No. 3,971,077.

It is an object of the present invention to provide a raised toilet seat in which the disadvantages described above are obviated or mitigated.

According to the present invention there is provided a toilet seat assembly including a toilet seat and seat holding bar assembly the toilet seat having a rearwardly directed extension therefrom presenting two spaced apart upwardly directed surfaces, each of which has at least one recess formed therein, the seat holding bar assembly being adapted for rigid attachment to a toilet bowl and having outwardly directed projections from each side thereof, each projection having a length which is sufficient to extend, in use, beyond the edges of the rear of the bowl, to which the assembly is fitted, the seat when fitted on the bowl having said upwardly directed surfaces below the bar projection with the projections engaged in said recesses.

Preferably the seat holding bar assembly has fixings attachable to a toilet bowl through the existing toilet seat fixing holes of the said bowl.

Preferably the toilet seat has a lower downwardly directed surface for engagement on the top of a toilet bowl and an upwardly directed seating surface spaced from said lower surface.

Preferably a downwardly extending flanged portion is provided on said lower surface and is accommodatable within the toilet bowl.

Preferably said seat is formed from plastics material by injection moulding, rotational moulding, blow moulding or any other suitable moulding technique. It may be hollow or filled.

Preferably an arm extends from each side of the seat, projecting upwardly and forwardly thereof, the arms being formed integrally with the seat.

Preferably each arm provides a top cantilevered portion presenting a substantially, in use, horizontal arm rest and an intermediate forwardly inclined portion between said seat and said top portion.

Preferably the rearwardly directed extension from the seat defines two mutually spaced mounting extensions, each of which defines an upper surface in which is formed the upwardly directed recesses.

Preferably at least, three recesses are provided in each upwardly directed surface. Each recess may have a semi-circular base and a longitudinal axis which is transverse to the front-to-rear axis of the seat.

The upper surface of the rearwardly directed extensions may be located below the lower surface of the toilet seat.

Preferably the bar assembly is formed from aluminium alloy by an extrusion process. The assembly may comprise a base plate adapted, in-use, to rest on the upper surface of the toilet bowl, web extending upwardly from the base plate and a bar at the top of said web.

Preferably the web extends upwardly from the rear edge of the base plate and holes through the base plate for attachment means are spaced from said web by a distance sufficient to mount a standard toilet seat on said base plate. The cross-section of the bar may be oval, having top and bottom semi-circular portions and a parallel-sided portion therebetween.

Preferably the bar projects beyond the outer end of the base plate and web at each side thereof.

Alternatively the bar assembly comprises a base plate having fixing holes and bar extensions at each end, the outer portions of which are directed downwardly and terminate in lugs adapted to engage in the recesses of the rearwardly directed extensions.

Preferably the base plate has fixing holes formed therethrough to receive fixing bolts adapted to pass through the base plate and the standard toilet seat fixing holes in the toilet bowl to which the bar assembly is to be fitted.

Means may be provided on the bar assembly for mounting a conventional toilet seat and lid.

An embodiment of the present invention will now be described by way of example only with reference to the accompanying drawings in which.

Figure 1:
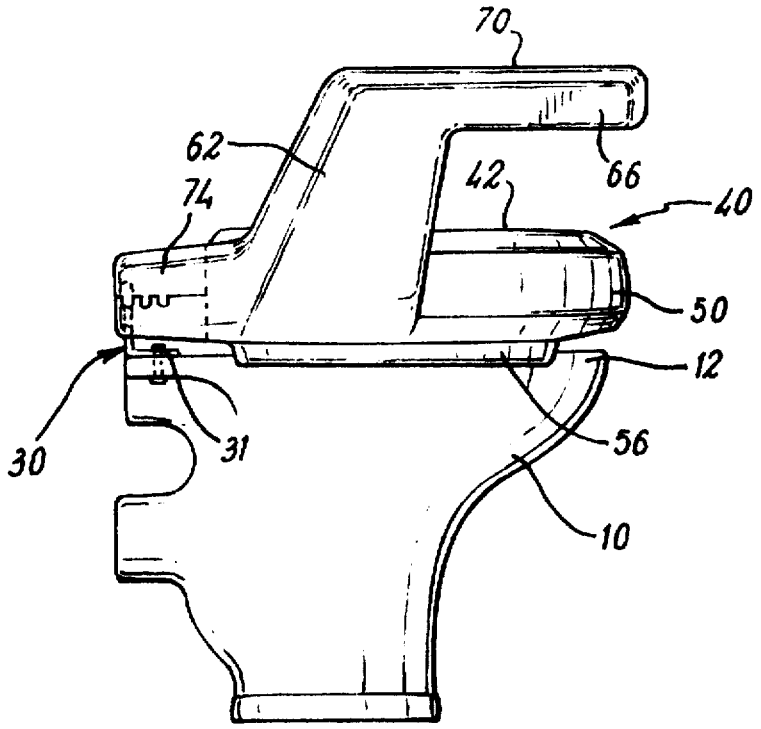
FIG. 1 is a side elevation of a toilet bowl with a raised toilet seat according to the present invention fitted thereon.
Figure 2:
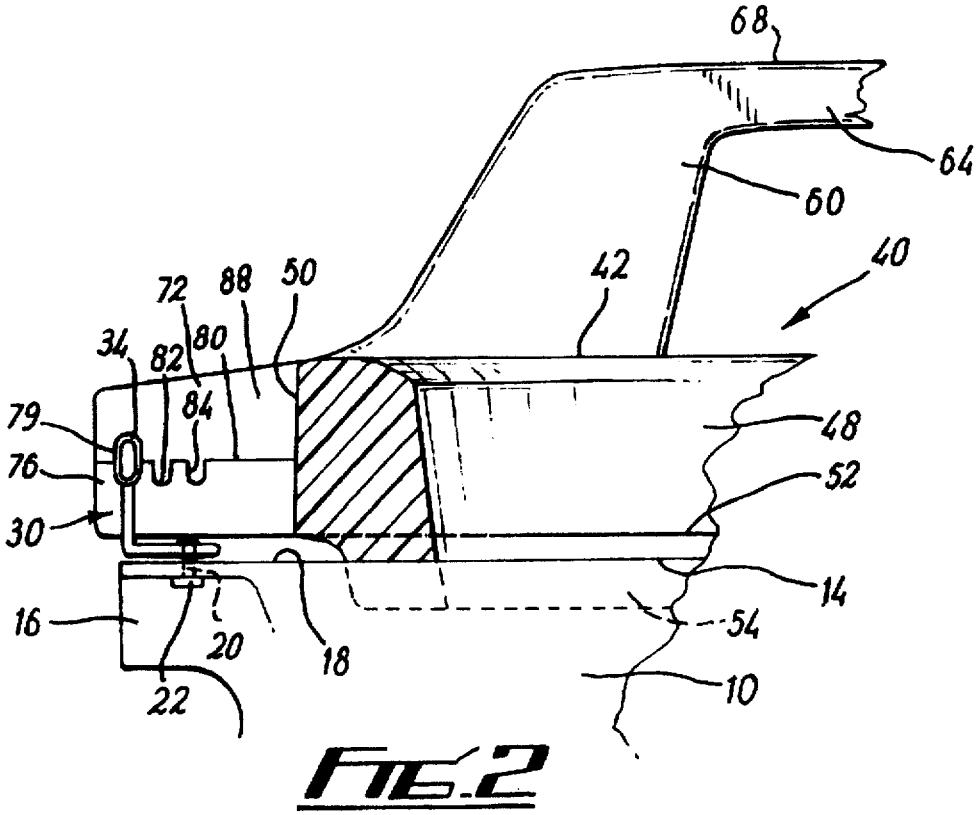
FIG. 2 is a fragmentary, sectional side elevation similar to FIG. 1 but to an enlarged scale.
Figure 3:
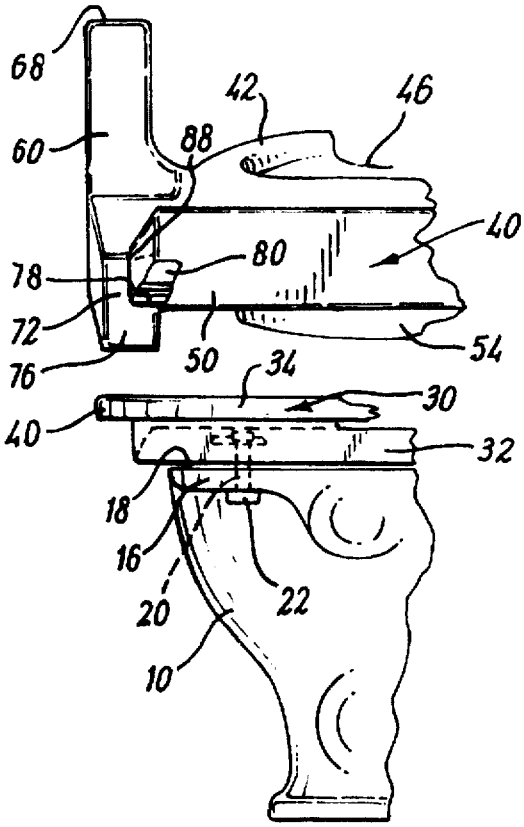
FIG. 3 is a fragmentary rear view of a toilet bowl with a seat about to be fitted thereon.
Figure 4:
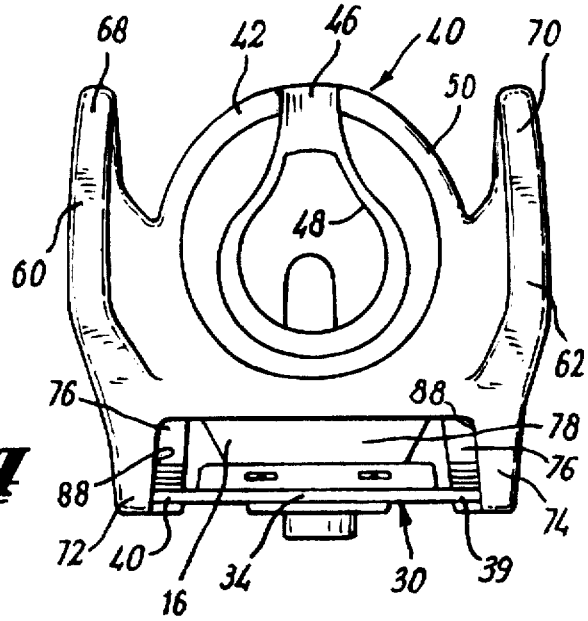
FIG. 4 is a plan view of the seat shown in FIG. 1 fitted on a toilet bowl.

Prior to describing the raised toilet seat of the present invention it will be helpful to consider the upper plan configuration of a toilet bowl. All toilet bowls (see FIGS. 1–4) in top plan have a bowl 10 defined by a rim 12 which is normally oval and presents a horizontal upper surface 14 on which the conventional toilet seat normally rests. The rim 12 of the bowl has a rearwardly directed extension 16 which is normally of lesser width than the greatest transverse width of the bowl, an upper surface 18 which is coincident with the upper surface 14 of the bowl and at least two fixing holes 20 formed therethrough to receive the bolts 22 normally fixing the mounting means by which the conventional toilet seat and lid is hinged to the bowl 10.

Figure 5:
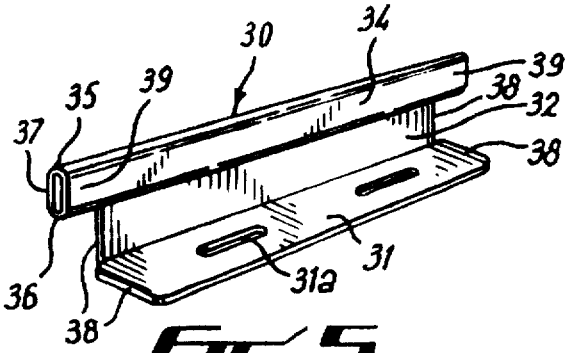
FIG. 5 is a perspective view from the front and one side of a seat mounting bar.
Figure 6:
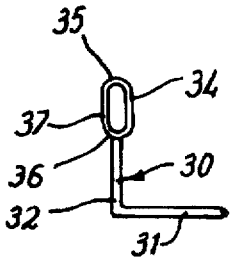
FIG. 6 is an end elevation of the bar.

The raised toilet seat assembly of the present invention includes a seat fixing bar assembly 30 shown particularly in FIGS. 5 and 6, normally extruded from aluminium alloy material and having a base plate 31 from which extends upwardly a solid web 32 surmounted by a hollow mounting bar 34, the cross-section of which has semi-circular portion 35,36 at its top and bottom joined by a parallel sided portion 37.

The bar 34 is of sufficient length to project beyond the edges 38 of The web and base plate which, in themselves, are slightly wider than the edges of the rear extension 16 from the toilet bowl 10, thus there are no obstacles presented by the toilet bowl beneath the projection 39 of the bar 34.

The web 32 extends upwardly from the rear edge of the base plate 31 which includes elongate apertures 31*a* to accommodate the fixing bolts 22. The web is spaced sufficiently from the apertures to permit the mounting of a standard toilet seat and, optionally its lid, which will be moved to their raised position when the raised toilet seat assembly is located on the toilet bowl.

A raised toilet seat 40, preferably formed from plastics material by any suitable moulding technique, for example, rotational moulding or injection moulding, comprises an upper seating surface 42 having a shaped depression 46 at its front. The upper surface 42 and depression 46 extend downwardly at their outer and inner edges to form inner and outer side walls 48,50 which, in turn, merge with a lower surface 52 which, towards it inner periphery has a downward projection 54 defining toilet bowl engaging flange 56.

Extending forwardly and upwardly from the outer wall 50 on each side of the seat 40 are formed from plastics material arm supports 60,62 which are hollow and are moulded integrally with the seat 40, the arm supports supporting forwardly extending cantilevered arms 64,66 which are again moulded integrally from plastics material and present upper surfaces 68,70.

Extending rearwardly from the arm supports 60,62 on each side of the seat 40 there are seat mounting extensions 72,74 which have an L-shaped configuration with the flange 76 of the L extending inwardly into the space 78 at the rear of the seat defined by the mounting extensions 72,74. Each flange 76 has three parallel, transversely extending depressions 79 formed in its upper surface 80, each depression having a semi-circular base 82 and two upstanding walls 84.

In operation, to fit the raised seat 40 to a toilet bowl 10, after the mounting bar assembly 30 has been securely clamped thereto by suitable fixing bolts 22, the raised seat 40 is presented to the bowl 10 in a rearwardly inclined orientation such that the mounting bar projections 39 are located in the space 78 between the mounting extensions 72,74 with the end of the projections 39 from the bar 34 located above the upper surface 80 of the flanges 76 of the extensions. This is possible due to the fact that there are no obstructions presented to the flanges 76 below the bar projection 39 by the toilet bowl 10.

The toilet seat 40 can then be pivoted downwardly about the axis close to but not at its rear, such that the flanged projection 54 from the lower surface 52 of the seat engages with the bowl 10. The upper surfaces 80 of the mounting extensions 72,74 move upwardly such that the bar projections 39 are accommodated in a corresponding pair of recesses 79 in the flange extensions.

It will be realised that the seat is now firmly located on the top of the toilet bowl and movement thereof in any direction other than a direction opposite to the movement described above when fitting the seat is not possible. For example, a tilting movement of the seat about its front-to-rear axis which would occur, for example, by a load being placed on one of the arms, is resisted by the bar projection on the side of the bar assembly opposite to that on which the load is being applied. Clearly the bar assembly itself is rigidly fixed to the top of the toilet bowl by the fixing bolts.

Similarly, front-to-rear movement is not possible as a result of the engagement of the bar in the correspondingly sized depressions and, furthermore, as a result in the engagement of the downwardly directed flange against at least certain areas of the inner, upper surface of the toilet bowl. Movement transverse to the front-to-rear axis of the seat is also prevented by inter-engagement between the downwardly directed flange and the inner upper surface of the bowl and by engagement of the ends of the bar 34 with the depressions 79 in the upper surfaces 80 of the mounting extensions 72,74 defining the space 78 at the rear of the seat.

It will be appreciated that the mounting means for the raised toilet seat provide the mounting effect at transversely spaced apart locations, that is at either end of the bar assembly so that with suitable modification a conventional toilet seat and lid can be mounted on the bar assembly. It is only necessary to raise the conventional toilet seat and lid to enable the raised seat to be fitted.

It will be appreciated also that the raised toilet seat with its integral arms can be readily removed from the toilet bowl by tilting it up by its forward end to disengage the bar from the depressions, moving it upwardly and outwardly in this angled configuration, thereby returning the toilet to its normal operating configuration.

Figure 7:
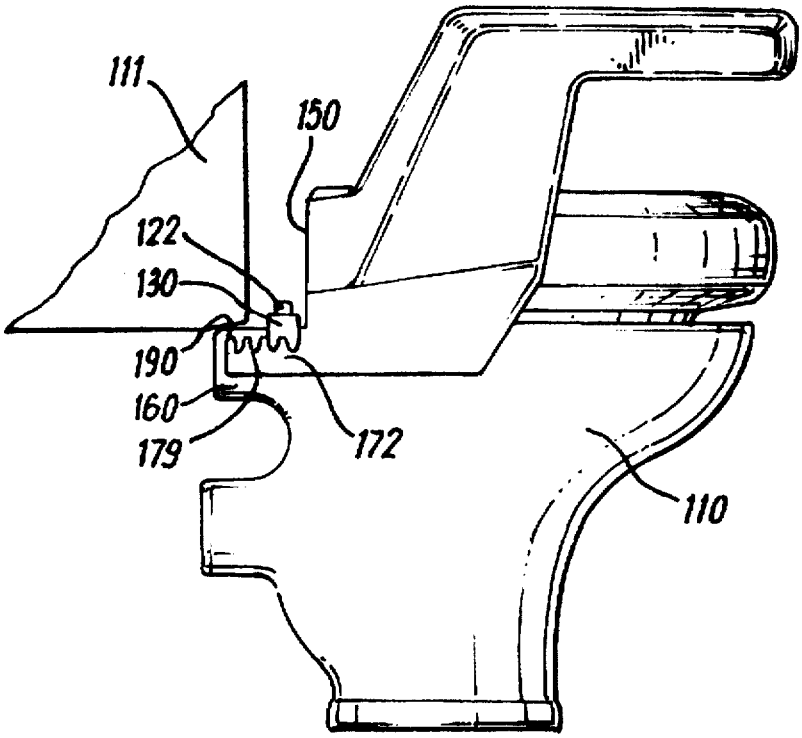
FIG. 7 is a view similar to FIG. 1 of a modified seat.

A modified seat is shown in FIG. 7 of the drawing and is intended for use on a toilet bowl 110 of the type where the cistern 111 sits on the rear upper facing surface of the bowl thereby precluding the use of the seat mounting bar of the type shown in FIGS. 1–6 and requiring a seat similar to that shown in FIGS. 1–4 but having seat mounting extensions 172 which present upper surfaces 190 which are located slightly below the plane of the top of the toilet bowl 110 such that they can extend under the cistern 111 and below the lower surface of the toilet seat. Unlike the toilet seat shown in FIGS. 1–4 the rearwardly extending seat mounting extensions are not flanged but are of rectangular configuration such that the rear outer surface 150 of the toilet is effectively planar.

Figure 8:
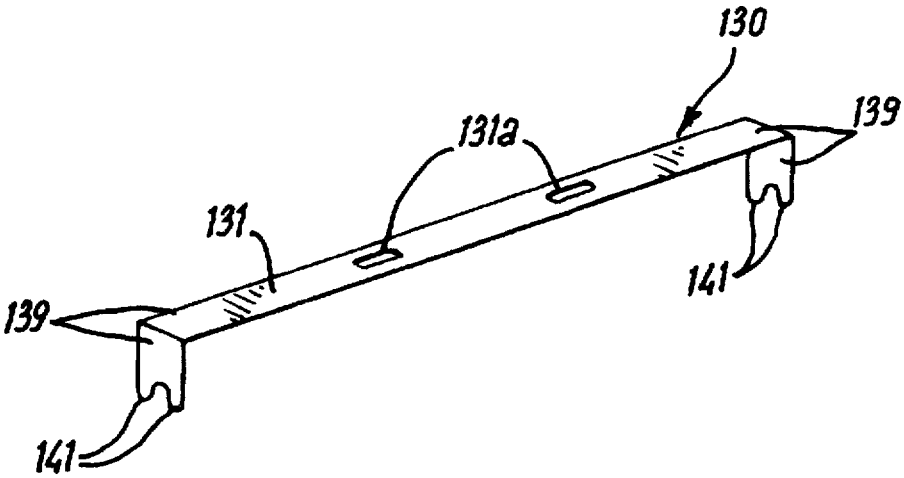
FIG. 8 is a perspective view from the front and one side of a modified seat mounting bar.

This seat is located on the toilet bowl by a seat fixing bar assembly 130 illustrated in FIGS. 7 and 8 which comprises a flat base plate 131 provided with apertures 131*a* to accommodate the usual fixing bolts 122.

The fixing bar 130 is, as before, of sufficient length to project beyond edges of the rear extension 60 from the toilet bowl and at each end has two projections 139 each of which extends outwardly then downwardly from the bar and has two semi-circular lugs 141 extending therefrom.

It will be appreciated from FIG. 7 that the modified toilet seat is fitted to the toilet bowl in the same way as the seat illustrated in FIGS. 1–4 and when in position the lugs 141 engage in depression 179 formed in the upper surface of the seat mounting extensions 172. This modified seat is also suitable for use in conjunction with a toilet bowl of the type illustrated in FIGS. 1–4, that is a bowl which is mounted separately from the cistern.

Various modifications can be made without departing from the scope of the invention, for example, the toilet seat need not present a raised surface but could provide a seating surface at normal level provided with arms. Equally, in a further modification the arms can be omitted. In other modifications the arms can take different configurations, for example, they need not be formed integrally with the set but could be formed as separate members fixed thereto by bolting, riveting, welding, adhesive or any other means. They may even be removably fitted to the seat.

The bar assembly could be fabricated from any suitable metal or could be moulded from a suitable plastics material. It is preferable that the fixing holes therein are such that variations in the position of the standard fixing holes in the toilet bowl can be accommodated. The fixing bolts for the bar assembly could be replaced by any suitable fixing means, for example, a quick-release toggle assembly. The seat can have any suitable configuration. The bar assembly could be fitted to the toilet bowl by means other than the bowl's fixing holes, for example, clamps on the bar could engage appropriate protrusions from the bowl.

I claim:

1. A raised toilet seat assembly for a toilet bowl having a rim and a rear portion, the rear portion defining a rear mounting surface of reduced width relative to the rim, said assembly comprising:

an elongate seat fixing bar assembly for being rigidly attached to the rear mounting surface of the toilet bowl, and having opposed ends adapted for projecting laterally outwardly beyond opposite sides of the rear mounting surface;

a toilet seat defining a lower downwardly facing surface for engagement on the rim of the toilet bowl and an upwardly facing seating surface spaced from said lower surface; and first and second laterally spaced rear mounting extensions projecting from a rear of the toilet seat and defining respective upwardly facing surfaces thereof, each of said surfaces of the mounting extensions having at least two spaced recesses therein for being selectively aligned and mated with respective opposed ends of the seat fixing bar assembly to secure the seat on the toilet bowl in one of a plurality of seating positions.

2. A raised toilet seat assembly according to claim 1, and including fixings for attaching the seat fixing bar assembly to the rear mounting surface of the toilet bowl through existing toilet seat fixing holes formed in the bowl.

3. A raised toilet seat assembly according to claim 1, wherein said toilet seat includes a downwardly extending flanged portion provided on said lower surface accommodatable within the rim of the toilet bowl.

4. A raised toilet seat assembly according to claim 1, wherein said toilet seat further includes a pair of arms extending from respective opposite sides of the seat and extending upwardly and forwardly thereof, the arms being formed integrally with the seat.

5. A raised toilet seat assembly according to claim 4, wherein which each arm includes a top cantilevered portion defining a substantially horizontal arm rest, and an intermediate forwardly inclined portion between the seating surface of the seat and said top cantilevered portion.

6. A raised toilet seat assembly according to claim 1, wherein which each recess of the mounting extensions has a semi-circular base and a longitudinal axis which is transverse to a front-to-rear axis of the seat.

7. A raised toilet seat assembly according to claim 1, wherein the upwardly facing surface of each rear mounting extension of the seat is located below the lower surface of the toilet seat.

8. A raised toilet seat assembly according to claim 1, wherein the seat fixing bar assembly includes a base plate, a base plate web extending upwardly from the base plate, and a horizontal bar attached along a top of said web.

9. A raised toilet seat assembly according to claim 8, wherein the web extends upwardly from a rear edge of the base plate, and wherein said base plate includes holes therethrough spaced forwardly from the web for receiving attachment means.

10. A raised toilet seat assembly according to claim 8, wherein a lateral cross-section of the horizontal bar defines an oval shape having top and bottom semi-circular portions and a parallel-sided portion therebetween.

11. A raised toilet seat assembly according to claim 8, wherein the horizontal bar projects beyond opposite sides of the base plate and web at each end thereof.

12. A raised toilet seat assembly according to claim 1, wherein the seat fixing bar assembly includes an elongate base plate having spaced-apart fixing holes therein and downwardly directed extensions at each end terminating in lugs adapted to engage in the recesses formed in the rear mounting extensions of the toilet seat.

* * * * *